US005326237A

United States Patent [19]

Cecil et al.

[11] Patent Number: 5,326,237

[45] Date of Patent: Jul. 5, 1994

[54] HIGH VOLUME PUMP WITH VALVE TUBE

[75] Inventors: Howard E. Cecil, Miramar, Fla.; Thomas Dupont, Hoschton, Ga.

[73] Assignee: Dupont Industries, Inc., Braselton, Ga.

[21] Appl. No.: 28,557

[22] Filed: Mar. 8, 1993

[51] Int. Cl.[5] ..... F04B 7/00

[52] U.S. Cl. ..... 417/511; 417/514; 417/520; 222/321

[58] Field of Search ..... 417/511 O, 514, 520, 417/545, 548, 467, 468, 469; 222/321, 383, 385

[56] References Cited

U.S. PATENT DOCUMENTS

| | | | |
|---|---|---|---|
| 3,237,571 | 3/1966 | Corsette | 417/520 |
| 3,361,078 | 1/1968 | Coopridge | 417/514 |
| 3,362,343 | 1/1968 | Duda | 417/520 |
| 3,362,344 | 1/1968 | Duda | 417/514 |

*Primary Examiner*—Richard A. Bertsch
*Assistant Examiner*—Alfred Basichas
*Attorney, Agent, or Firm*—Oltman and Flynn

[57] ABSTRACT

A pump for moving a fluid includes an outer chamber having a first end wall portion containing a fluid entrance port and a second end wall portion containing a fluid exit port, a valve tube slidably contained within the chamber and having a first edge with a cut out section, adjacent the chamber first end wall portion, a first cup member within the valve tube having an outwardly flared side wall with a lip resiliently bearing against the valve tube adjacent the first edge and having a bottom wall smaller than the chamber first end wall portion, spacer connecting and spacing apart the first cup member bottom wall and the chamber first end wall portion, a plunger having a tubular stem portion containing a check valve plug and extending through the chamber exit port, and having a second cup member contained within the valve tube and also having a bottom wall with a hole opening into the stem portion and an outwardly flared side wall bearing against the valve tube and oriented to oppose the first cup member, such that when the stem portion is moved outward through the exit port, the first and second cup members move apart and create a low pressure area between them, while the friction of the second cup member dragging against the valve tube moves the valve tube cut out section to a position beside the side wall lip of the first cup member, permitting liquid to pass through the entrance port and the cut out section and into the valve tube between the first and second cup members.

11 Claims, 2 Drawing Sheets

HIGH VOLUME PUMP WITH VALVE TUBE

BACKGROUND OF THE INVENTION

1. Field of the Invention

The present invention relates generally to the field of pumps for moving liquids, and more specifically to a high volume pump for low viscosity liquids such as water as well as high viscosity liquids such as shampoo, mustard and ketchup, the pump including an outer cylindrical chamber having a central entrance port in a first end wall and a central exit port in a second end wall, a valve tube slidably contained within the cylindrical chamber and having cut out sections in a first edge nearest the chamber first end wall, a first cup member having an outwardly flared side wall with a lip resiliently bearing against the inner surface of the valve tube to create a seal near the valve tube first edge with the cut out sections beyond the side wall lip and a circular bottom wall with a diameter smaller than that of the first chamber end wall, the first cup member bottom wall being connected to spacer members extending from the first end wall, a plunger having a tubular stem containing a check valve plug and extending through the chamber exit port and having a second cup member attached to the tubular stem within the chamber also having an outwardly flared side wall bearing against the inner surface of the valve tube to create a seal and oriented to oppose the first cup member, so that when the plunger stem is slid out though the exit port, the first and second cup members move apart and create a low pressure area or vacuum between them, while the friction of the second cup member dragging against the valve tube pulls the valve tube a certain distance relative to the first cup member, and thus moves the valve tube first edge cut out sections beyond the first cup member side wall lip, breaking the seal and permitting liquid to be drawn by the vacuum through the chamber entrance port, around the first cup member side wall and through the cut out sections to enter the valve tube between the first and second cup members; and pushing the plunger stem back through the exit port causes the second cup member to once again drag against the valve tube and move the cut out sections back beyond the first cup member side wall lip, restoring the first cup member seal and pressurizing the liquid between the cup members, driving the liquid into a hole in the second cup member bottom wall and up through the plunger stem, dislodging the check valve plug in the stem and permitting the pressurized liquid to enter a nozzle and escape.

2. Description of the Prior Art

There have long been pumps for use in vessel lids for dispensing cleaning fluids, mustard, and other liquids. A problem with these pumps has been that they almost invariably contain floating ball type check valves. These check valves have proven unreliable, often sticking, jamming and blocking fluid delivery, or moving out of position and leaking when the pump is left resting on its side. Another problem with these ball check valves has been that they can greatly increase the expense of the pump.

It is thus an object of the present invention to provide a high velocity, high volume pump suited for use in vessel lids and tops, and which is reliable and does not include any ball check valves.

It is another object of the present invention to provide such a pump which seals against leakage at all times and in any orientation or position.

It is still another object of the present invention to provide such a pump which delivers liquid with minimal pump action, and does not require extensive priming.

It is finally an object of the present invention to provide such a pump which has a design well suited for easy and inexpensive molding and assembly.

SUMMARY OF THE INVENTION

The present invention accomplishes the above-stated objectives, as well as others, as may be determined by a fair reading and interpretation of the entire specification.

A pump is provided for moving a fluid, including an outer chamber having a first end wall portion containing a fluid entrance port and a second end wall portion containing a fluid exit port, a valve tube slidably contained within the chamber and having a first edge with a cut out section, adjacent the chamber first end wall portion, a first cup member within the valve tube having an outwardly flared side wall with a lip resiliently bearing against the valve tube adjacent the first edge and having a bottom wall smaller than the chamber first end wall portion, spacer means connecting and spacing apart the first cup member bottom wall and the chamber first end wall portion, a plunger having a tubular stem portion containing a check valve plug and extending through the chamber exit port, and having a second cup member contained within the valve tube and also having a bottom wall with a hole opening into the stem portion and an outwardly flared side wall bearing against the valve tube and oriented to oppose the first cup member, such that when the stem portion is moved outward through the exit port, the first and second cup members move apart and create a low pressure area between them, while the friction of the second cup member dragging against the valve tube moves the valve tube cut out section to a position beside the side wall lip of the first cup member, permitting liquid to pass through the entrance port and the cut out section and into the valve tube between the first and second cup members; and pushing the plunger stem portion back through the exit port causes the second cup member to once again drag against the valve tube and move the cut out section toward the first end wall portion and beyond the first cup member side wall lip, pressurizing the liquid within the valve tube, the liquid thereby being driven up through the second cup member bottom wall hole and the plunger stem portion, dislodging the check valve plug and permitting the pressurized liquid to escape through the plunger stem portion. A recess is preferably provided in the outer surface of the plunger stem for permitting air to escape from the chamber as the stem portion is depressed and the recess passes through the exit port. A coil spring is preferably contained within the valve tube and bearing against the first and second cup members to bias the first and second cup members apart. The plug is preferably a frustum-shaped member fitting snugly and sealingly into a beveled end of the plunger stem portion. A spring preferably bears against a portion of the pump to bias the plug in a sealed position within the beveled end of the stem portion. The pump may be contained within a vessel lid for securing over the mouth of a vessel, and additionally includes an outer flange extending radially from the chamber outer surface and engaging the vessel lid, the lid having a radial lid flange with a lip at the remote edge of the radial lid flange, the tubular lid portion extending away from the lid flange along the stem portion of the plunger, and a sealing flange extending radially inward toward the valve stem, a sealing lip extending from the sealing flange along and toward the stem portion, resiliently bearing laterally against the stem portion outer surface to seal around the stem portion so that a vacuum can be created when the stem portion is moved outward through the chamber exit port. A liquid delivery nozzle structure is preferably mounted on the end of the plunger stem portion remote from the chamber, including a tube mounted essentially perpendicular to and in fluid communication with the plunger stem portion. A nozzle structure top wall portion may extend over the nozzle tube and serving as a surface against which pressure can be applied to push the plunger stem portion into the entrance port. A fastening mechanism may be provided on the nozzle flange for engaging a projection extending from the sealing flange to lock the stem portion in a depressed position. The pump is preferably formed of polypropylene plastic.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
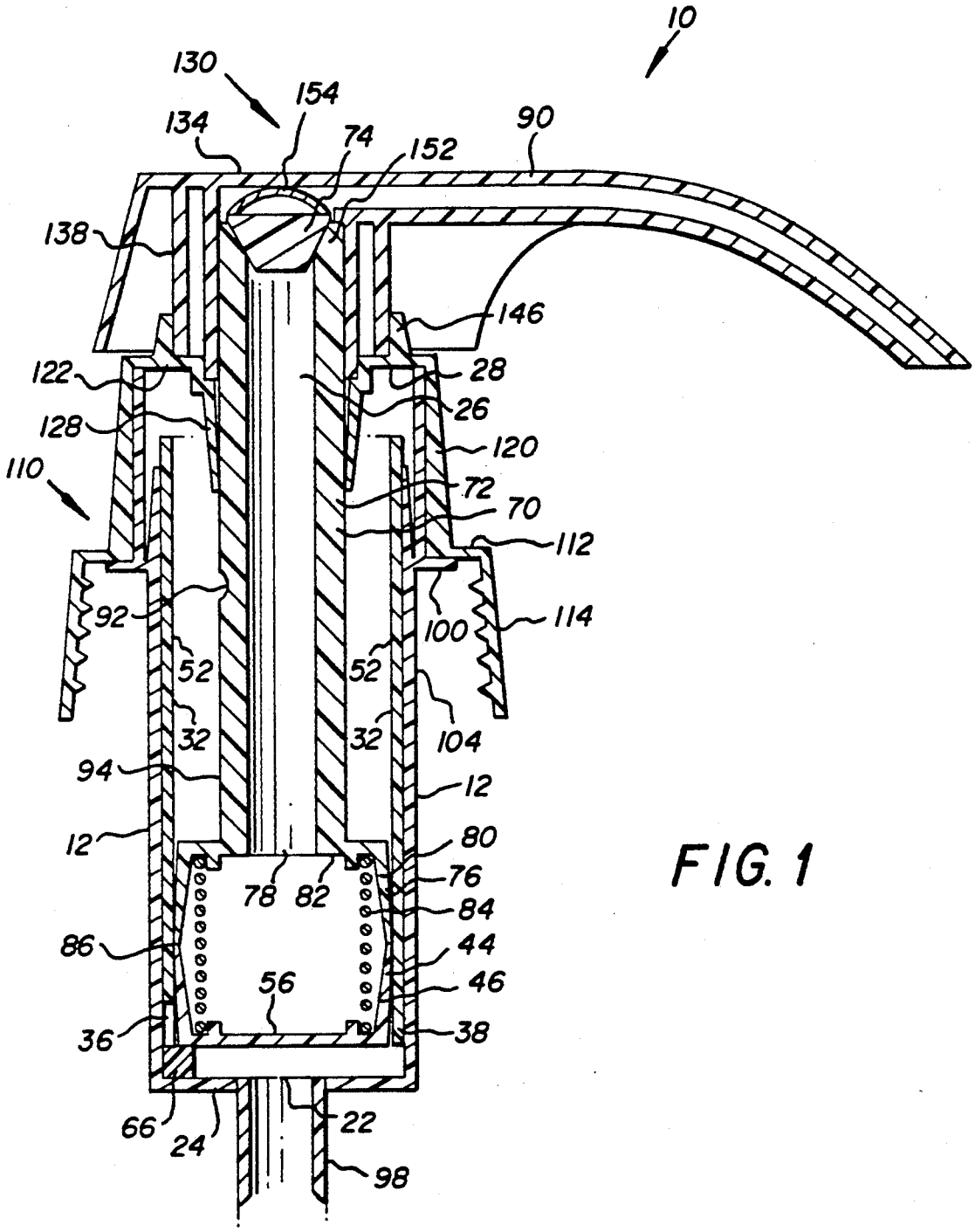
FIG. 1 is a cross-sectional side view of the inventive pump with the plunger in the retracted position.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various figures are designated by the same reference numerals.

First Preferred Embodiment

Figures 2, 3:
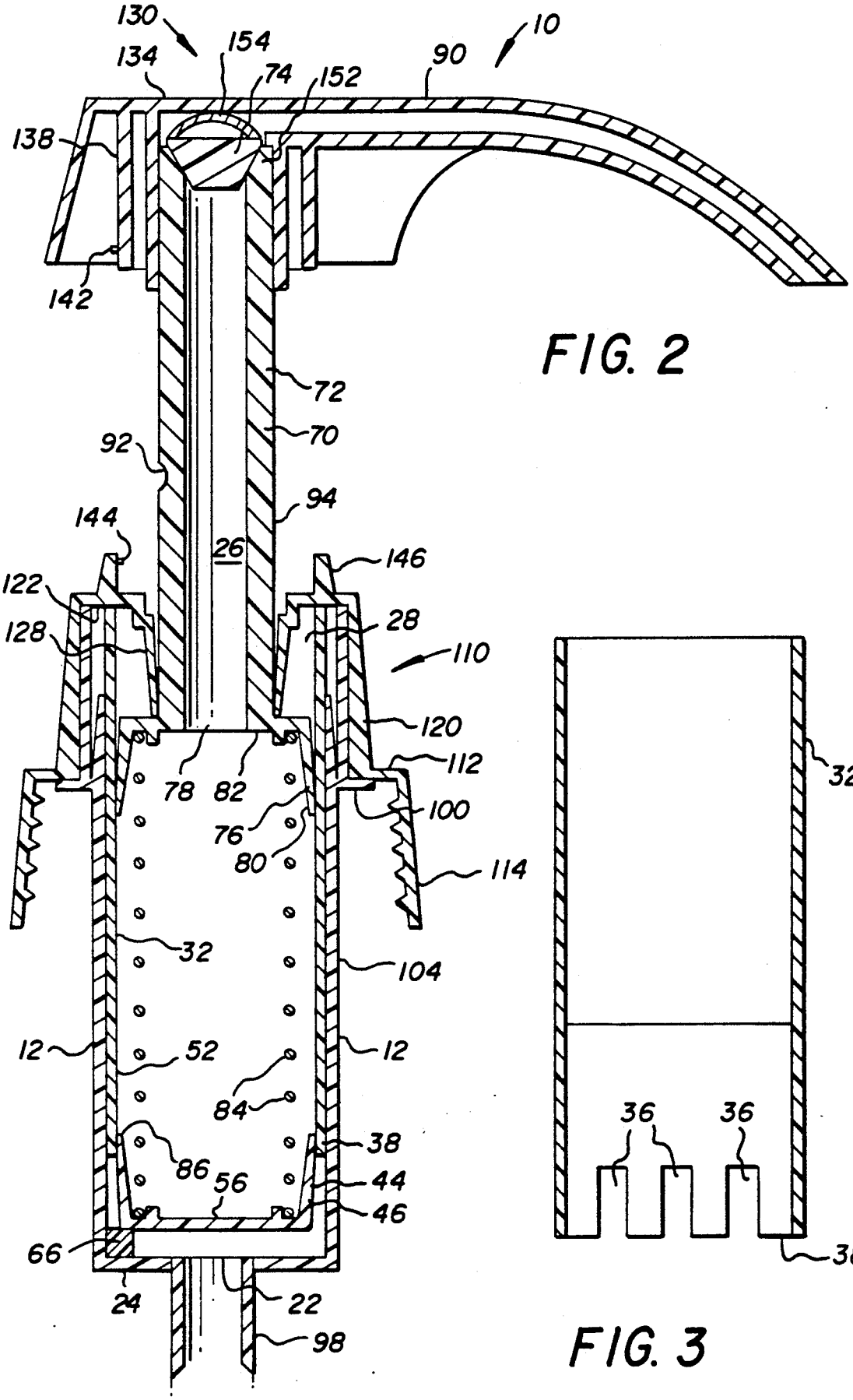
FIG. 2 is a cross-sectional side view of the inventive pump with plunger in the extended position.
FIG. 3 is a cross-sectional side view of the valve tube showing the cut out sections, similar to a castle turret.

Referring to FIGS. 1 and 2, a high volume pump 10 is disclosed for moving low viscosity liquids such as water as well as high viscosity liquids such as shampoo, mustard and ketchup. Smaller versions of pump 10 may be used in household vessel lids and larger versions may be used for many other purposes.

Pump 10 includes an outer cylindrical chamber 12 having a central entrance port 22 in a first end wall 24 and a central exit port 26 in a second end wall 28. A valve tube 32 is slidably contained within chamber 12 and has cut out sections 36 in a first edge 38 adjacent chamber first end wall 24. See FIG. 3. A first cup member 44 is contained within chamber 12 and has a circular bottom wall 56 connected to spacer members 66 which are in turn connected to first end wall 24. First cup member 44 has an outwardly flared side wall 46 which resiliently bears against the inner surface 52 of valve tube 32 near first edge 38. Bottom wall 56 has a diameter smaller than that of chamber first end wall 24. Pump 10 includes a plunger 70 having a tubular stem 72 which contains a check valve plug 74 and which extends through chamber exit port 26, and also includes a second cup member 76 contained within chamber 12. Second cup member 76 has a bottom wall 82 with a hole 78 leading into stem 72 and also has an outwardly flared side wall 80 bearing against inner surface 52 of valve tube 32. Second cup member 76 is oriented to oppose first cup member 44.

A coil spring 84 is provided within chamber 12 and extends between the bottom walls 56 and 82 of cup members 44 and 76, to bias plunger stem 72 outward in an extended position. When coil spring 84 pushes plunger 70 out through exit port 26, first and second cup members 44 and 76 move apart and create a low pressure area or vacuum in the space between them. The friction of second cup member 76 dragging against valve tube inner surface 52 pulls valve tube 32 a certain distance relative to first cup member 44, and moves first edge 38 relative to the lip 86 of first cup member 44. This action moves valve tube cut out sections 36 around first cup member lip 86, breaking the first cup member 44 seal with valve tube 32. The vacuum draws a quantity of liquid through entrance port 22, around first cup member side wall 46 and through cut out sections 36, into valve tube 32 between first and second cup members 44 and 76.

Pushing plunger 70 back through the exit port 26 and into chamber 12 causes second cup member 76 to once again drag against valve tube inner surface 52 and move cut out sections 36 back behind first cup member lip 86. This action restores the first cup member 44 seal and pressurizes the quantity of liquid contained between cup members 44 and 76. The liquid is thereby driven up through hole 78 and plunger tubular stem 72, dislodging check valve plug 74 in stem 72 and permitting the pressurized liquid to escape through a nozzle tube 90.

A circular recess 92 in the outer surface 94 of plunger stem 72 permits air trapped between cup member 76 and second end wall 28 to enter and escape as plunger stem 72 is depressed into and retracted from chamber 12. Coil spring 84 is contained within and is essentially coaxial with valve tube 32. Spring 84 bears against the outward portions of bottom walls 56 and 82 of the first and second cup members 44 and 76. A well tube 98 extends from entrance port 22 to reach liquid to be pumped.

An outer flange 100 optionally extends radially from the chamber 12 outer surface 104 and engages a bottle lid structure 110. Lid structure 110 has a radial lid flange 112 with a lip 114 at its remote edge containing an interior screw thread for fastening to an exterior screw thread on the mouth of a vessel containing liquid to be pumped. A tubular lid portion 120 extends away from lid flange 112 along valve stem 72, and a sealing flange 122 extends radially inward toward valve stem 72. Second end wall 28 comprises sealing flange 122. A sealing lip 128 extends from sealing flange 122 along and toward plunger stem 72, resiliently bearing laterally against stem 72 outer surface 132 to seal around stem 72. This seal permits the vacuum mentioned above to be created in chamber 12 when plunger stem 72 is pushed outward through exit port 26.

A liquid delivery nozzle structure 130 is mounted on the remote end of plunger stem 72. Nozzle structure 130 includes nozzle tube 90 which is mounted perpendicular to and in fluid communication with plunger stem 72, and preferably curves slightly downward toward the vessel on which pump 10 is mounted. A broad top wall portion 134 extends over nozzle tube 90 and serves as a surface against which pressure can be applied by hand to push plunger stem 72 into entrance port 22. A nozzle flange 138 preferably extends from the edges of top wall portion toward the vessel, to protect the user from uncomfortable pressure against top wall portion 134 edges and for aesthetic purposes.

Nozzle flange 138 has an exterior thread 142 which can engage an interior thread 144 on a projection 146 extending from sealing flange 122 to lock plunger stem 72 in the depressed position. This feature is particularly important for shipping pump 10 as part of a vessel full of liquid, to prevent accidental pumping.

Plug 74 is preferably a frustum-shaped member fitting snugly and sealingly into the remote end 152 of plunger stem 72 at the nozzle tube 90. End 152 preferably has an interior bevel to match the plug 74 shape. Plug 74 also has a leaf spring 154 bowing against the inner wall of nozzle tube 90 over stem 72. Plug 74 seals stem 72 until pressurized liquid within stem 72 compresses spring 154 and momentarily unseats plug 74 during pumping.

Pump 10 is preferably made of either polypropylene and polyethylene plastic, or some combination of these. Cup members 44 and 76 may equivalently be replaced with any type of member which will provide a satisfactory seal and frictional contact with valve tube 32.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim as our invention:

1. A pump for moving a fluid, comprising:

an outer chamber having a first end wall portion containing a fluid entrance port and a second end wall portion containing a fluid exit port, a valve tube slidably contained within said chamber and having a first edge with a cut out section, adjacent said chamber first end wall portion, a first sealing member within said valve tube having a side edge resiliently bearing against said valve tube adjacent said first edge and having a bottom wall smaller than said chamber first end wall portion, spacer means connecting and spacing apart said first sealing member and said chamber first end wall portion, a plunger having a tubular stem portion containing a check valve plug and extending through said chamber exit port, and having a second sealing member contained within said valve tube and also having a side edge and a hole opening into said stem portion and an outwardly flared side wall bearing against said valve tube and oriented to oppose said first sealing member, such that when said stem portion is moved outward through said exit port, said first and second sealing members move apart and create a low pressure area between them, while the friction of said second sealing member dragging against said valve tube moves said valve tube cut out section to a position beside said side wall edge of said first sealing member, permitting liquid to pass through said entrance port and said cut out section and into said valve tube between said first and second sealing members; and pushing said plunger stem portion back through said exit port causes said second sealing member to once again drag against said valve tube and move said cut out section toward said first end wall portion and beyond said first sealing member side wall edge, pressurizing said liquid within the valve tube, the liquid thereby being driven up through said second sealing member hole and said plunger stem portion, dislodging said check valve plug and permitting said pressurized liquid to escape through said plunger stem portion.

2. A pump for moving a fluid, comprising:

an outer chamber having a first end wall portion containing a fluid entrance port and a second end wall portion containing a fluid exit port, a valve tube slidably contained within said chamber and having a first edge with a cut out section, adjacent said chamber first end wall portion, a first cup member within said valve tube having an outwardly flared side wall with a lip resiliently bearing against said valve tube adjacent said first edge and having a bottom wall smaller than said chamber first end wall portion, spacer means connecting and spacing apart said first cup member bottom wall and said chamber first end wall portion, a plunger having a tubular stem portion containing a check valve plug and extending through said chamber exit port, and having a second cup member contained within said valve tube and also having a bottom wall with a hole opening into said stem portion and an outwardly flared side wall bearing against said valve tube and oriented to oppose said first cup member, such that when said stem portion is moved outward through said exit port, said first and second cup members move apart and create a low pressure area between them, while the friction of said second cup member dragging against said valve tube moves said valve tube cut out section to a position beside said side wall lip of said first cup member, permitting liquid to pass through said entrance port and said cut out section and into said valve tube between said first and second cup members; and pushing said plunger stem portion back through said exit port causes said second cup member to once again drag against said valve tube and move said cut out section toward said first end wall portion and beyond said first cup member side wall lip, pressurizing said liquid within the valve tube, the liquid thereby being driven up through said second cup member bottom wall hole and said plunger stem portion, dislodging said check valve plug and permitting said pressurized liquid to escape through said plunger stem portion.

3. A pump according to claim 2, additionally comprising:

a recess in the outer surface of said plunger stem for permitting air to escape from said chamber as said stem portion is depressed and said recess passes through said exit port.

4. A pump according to claim 2, additionally comprising:

a coil spring contained within said valve tube and bearing against said first and second cup members to bias said first and second cup members apart.

5. A pump according to claim 2, wherein said plug is a frustum-shaped member fitting snugly and sealingly into a beveled end of said plunger stem portion.

6. A pump according to claim 5, wherein said plug additionally comprises a spring bearing against a portion of said pump to bias said plug in a sealed position within said beveled end of said stem portion.

7. A pump according to claim 2, wherein said pump is contained within a vessel lid for securing over the mouth of a vessel, additionally comprising:

an outer flange extending radially from said chamber outer surface and engaging said vessel lid, said lid having a radial lid flange with a lip at the remote edge of said radial lid flange, said tubular lid portion extending away from said lid flange along said stem portion of said plunger, and a sealing flange extending radially inward toward said valve stem, a sealing lip extending from said sealing flange along and toward said stem portion, resiliently bearing laterally against said stem portion outer surface to seal around said stem portion so that a vacuum can be created when said stem portion is moved outward through said chamber exit port.

8. A pump according to claim 2, additionally comprising:

a liquid delivery nozzle structure mounted on the end of said plunger stem portion remote from said chamber, including a tube mounted essentially perpendicular to and in fluid communication with said plunger stem portion.

9. A pump according to claim 8, additionally comprising:

a nozzle structure top wall portion extending over said nozzle tube and serving as a surface against which pressure can be applied to push said plunger stem portion into said entrance port.

10. A pump according to claim 9, additionally comprising:

fastening means on said nozzle flange for engaging a projection extending from said sealing flange to lock said stem portion in a depressed position.

11. A pump according to claim 2, wherein said pump is formed of polypropylene plastic.

* * * * *